US008448725B2

(12) United States Patent
Mensa-Wilmot

(10) Patent No.: US 8,448,725 B2
(45) Date of Patent: May 28, 2013

(54) IMPACT RESISTANT PDC DRILL BIT

(75) Inventor: Graham Mensa-Wilmot, Spring, TX (US)

(73) Assignee: Smith International, Inc., Houston, TX (US)

( * ) Notice: Subject to any disclaimer, the term of this patent is extended or adjusted under 35 U.S.C. 154(b) by 1346 days.

(21) Appl. No.: 11/009,627

(22) Filed: Dec. 10, 2004

(65) Prior Publication Data

US 2006/0124358 A1 Jun. 15, 2006

(51) Int. Cl.
*E21B 10/43* (2006.01)
*E21B 10/42* (2006.01)

(52) U.S. Cl.
USPC ..... 175/428; 175/57

(58) Field of Classification Search
USPC ..... 175/57, 379, 428
See application file for complete search history.

(56) References Cited

U.S. PATENT DOCUMENTS

| | | | | |
|---|---|---|---|---|
| 5,238,074 | A * | 8/1993 | Tibbitts et al. | 175/428 |
| 5,244,039 | A | 9/1993 | Newton, Jr. et al. | |
| 5,549,171 | A * | 8/1996 | Mensa-Wilmot et al. | 175/431 |
| 5,551,522 | A | 9/1996 | Keith et al. | 175/420.2 |
| 5,582,261 | A | 12/1996 | Keith et al. | 175/431 |
| 5,592,996 | A | 1/1997 | Keith et al. | |
| 5,607,024 | A | 3/1997 | Keith et al. | 175/431 |
| 5,960,896 | A * | 10/1999 | Barr et al. | 175/431 |
| 6,173,797 | B1 * | 1/2001 | Dykstra et al. | 175/374 |
| 6,230,828 | B1 | 5/2001 | Beuershausen et al. | |
| 6,481,511 | B2 | 11/2002 | Matthias et al. | 175/431 |
| 6,536,543 | B2 * | 3/2003 | Meiners et al. | 175/431 |
| 6,607,025 | B2 | 8/2003 | Gille | |
| 2001/0003932 | A1 | 6/2001 | Packer | |
| 2001/0040053 | A1 | 11/2001 | Beuershausen et al. | |
| 2003/0051922 | A1 | 3/2003 | Baker et al. | |

FOREIGN PATENT DOCUMENTS

| | | |
|---|---|---|
| GB | 2317195 | 3/1998 |
| GB | 2361496 | 10/2001 |

OTHER PUBLICATIONS

Search and Examination Report for Application No. GB0524547.7 dated Apr. 19, 2006; (4 p.).
Search Report for Appln. No. GB 0524547.7 dated Feb. 20, 2006; (1 p.).

* cited by examiner

*Primary Examiner* — Brad Harcourt

(57) ABSTRACT

A drill bit includes at least two different sets of cutting elements, each being the primary cutting set corresponding to a different formation. Upon encountering a significant change in formation characteristics, the first set of cutting elements may be sacrificed so that the second set of cutting elements becomes exposed, preventing the need to replace the drill bit immediately. The sets of cutting elements differ from one another, with each adapted to cut a different formation. The differences may include material toughness (impact resistance), bevel size, abrasion resistance, or backrake angle. Additional sets of cutting elements may be added to correspond to other formations or to otherwise improve performance.

59 Claims, 6 Drawing Sheets

IMPACT RESISTANT PDC DRILL BIT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of the Invention

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling rig located at the surface of the borehole. Such apparatus turns the bit and advances it downwardly, causing the bit to cut through the formation material by abrasion, fracturing, or shearing action, or through a combination of all cutting methods. While the bit is rotated, drilling fluid is pumped through the drill string and directed out of the drill bit through nozzles that are positioned in the bit face. The drilling fluid is provided to cool the bit and to flush cuttings away from the cutting structure of the bit. The drilling fluid and cuttings are forced from the bottom of the borehole to the surface through the annulus that is formed between the drill string and the borehole.

Many different types of drill bits and cutting structures for bits have been developed and found useful in drilling such boreholes. Such bits include fixed cutter bits and roller cone bits. The types of cutting structures include milled tooth bits, tungsten carbide insert ("TCI") bits, PDC bits, and natural diamond bits. The selection of the appropriate bit and cutting structure for a given application depends upon many factors. One of the most important of these factors is the type of formation that is to be drilled. More particularly, in some programs, the problem is the range of formations that will be encountered.

Depending upon formation hardness, abrasiveness, or other characteristics, certain combinations of the above-described bit types and cutting structures will work more efficiently and effectively than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting structure provide the best combination of penetration rate and durability.

In recent years, fixed cutter bits having a PDC cutting structure have been employed with varying degrees of success for cutting various formations. The cutting elements used in such bits are formed of extremely hard materials and include a layer of thermally stable polycrystalline diamond material. In the typical PDC bit, each cutter element or assembly comprises an elongate and generally cylindrical support member which is received and secured in a pocket formed in the surface of the bit body. A disk or tablet-shaped, preformed cutting element having a hard cutting layer of polycrystalline diamond is bonded to the exposed end of the support member, which is typically formed of tungsten carbide. Although such cutter elements historically were round in cross section and included a disk shaped PDC layer forming the cutting face of the element, improvements in manufacturing techniques have made it possible to provide cutter elements having PDC layers and tungsten carbide support bodies formed in other shapes as well.

The length of time that a drill bit may be employed before the drill string must be tripped to change the bit depends upon the bit's rate of penetration ("ROP"), as well as its durability or ability to maintain a high or acceptable ROP.

The cost of drilling a borehole is proportional to the length of time it takes to drill the borehole to the desired depth and location. The drilling time, in turn, is greatly affected by the number of times the drill bit must be changed in order to reach the targeted formation. This is because each time the bit is changed the entire drill string—which may be miles long—must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits which will drill faster and longer and which are usable over a wide range of differing formations.

In drilling a wellbore through the earth an abrupt variation in formation characteristics over a very short interval may be encountered. One good example is drastic changes in formation hardness. This may occur where there are nodules or boulders of hard rock (such as calcite) embedded in soft sand. Alternately, there may be numerous layers of alternately soft and hard formation.

Severe damage to the drill bit can and often will result when drastic variations in formation hardness are observed over short intervals. For example, the drill bit may be moving from a softer formation layer to a much harder formation layer within a short span of depth or footage or vice versa. Such a situation causes breakage of a drill bit's cutting structure or cutting elements due to impact loads. The greater the number of sudden formation hardness transitions, from soft to hard or hard to soft, the more the damage is inflicted on the drill bit. Such formation configurations may quickly break virtually every cutter on the face of the drill bit. Analogous problems exist for other changes in formation characteristics, such as the abrasiveness of the formation.

Where the drill bit is damaged, the drill string must be removed or "tripped" from the wellbore, the drill bit replaced, and the drill string reinserted, section by section, into the wellbore. In regions where there are numerous and sudden transitions in formation characteristics, multiple drill bits may be destroyed. This requires tripping the drill bit numerous times.

A drill bit is needed that can withstand the forces that are created when a sudden transition in formation characteristics is encountered. Without experiencing the usual damage seen in such applications, such a drill bit will be able to continue drilling at an acceptable ROP and thus save numerous bit trips. Even more helpful would be if this drill bit could drill through homogenous or slowly changing formations above or below the high variability region, such that these bits are also able to drill regions other than those that have highly-variable hardnesses or other highly-variable formation characteristics.

SUMMARY OF THE INVENTION

The invention features a drill bit having first and second sets of cutting elements mounted to its face end. In first embodiments, each of the first and second sets of cutting elements have cutters with impact resistance (toughness), backrake angle, and bevel size, with at least two of the following being true for a given cutting element in the first set and a given element in the second set: the impact resistance in the second set of cutting elements is different than in the first set of cutting elements, the bevel size for the second set of cutting elements is different than for the first set of cutting elements, and the backrake angle for the second set of cutting elements is different than for the first set of cutting elements. More specifically, two of the following, and preferably all three of the following, are true for a given cutting element in the first set and a given cutting element in the second set: the impact resistance for the cutting element in the second set of cutting elements is greater than for the given cutting element in the first set of cutting elements, the bevel size for the given cutting element in the second set of cutting elements is larger than for the given cutting element in the first set of cutting elements, and the backrake angle for the second set of cutting elements is less aggressive than for the given cutting element in the first set of cutting elements. In many embodiments, all three of these conditions are satisfied for all of the elements in the first and second set of cutting elements. A third set of cutting elements may be added with similar relationships, in addition to other changes and variations.

In second embodiments, each of the first and second sets of cutting elements have cutters with abrasion resistance, backrake angle, and bevel size, with at least two of the following being true for a given cutting element in the first set and a given element in the second set: the abrasion resistance in the second set of cutting elements is different than in the first set of cutting elements, the bevel size for the second set of cutting elements is different than for the first set of cutting elements, and the backrake angle for the second set of cutting elements is different than for the first set of cutting elements. More specifically, two of the following, and preferably all three of the following, are true for a given cutting element in the first set and a given cutting element in the second set: the abrasion resistance for the cutting element in the second set of cutting elements is greater than for the given cutting element in the first set of cutting elements, the bevel size for the given cutting element in the second set of cutting elements is larger than for the given cutting element in the first set of cutting elements, and the backrake angle for the second set of cutting elements is less aggressive than for the given cutting element in the first set of cutting elements. In many embodiments, all three of these conditions are satisfied for all of the elements in the first and second set of cutting elements.

In third embodiments, the difference is a change in bevel size between a first set of cutting elements and a second set of cutting elements, the first and second sets of cutting elements being at substantially the same radial position.

The invention may also be expressed as a method to cut a borehole through multiple regions of formation. Such a method includes sacrificing a first set of cutting elements to expose a second set of cutting elements, the first and second set of cutting elements having different characteristics.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
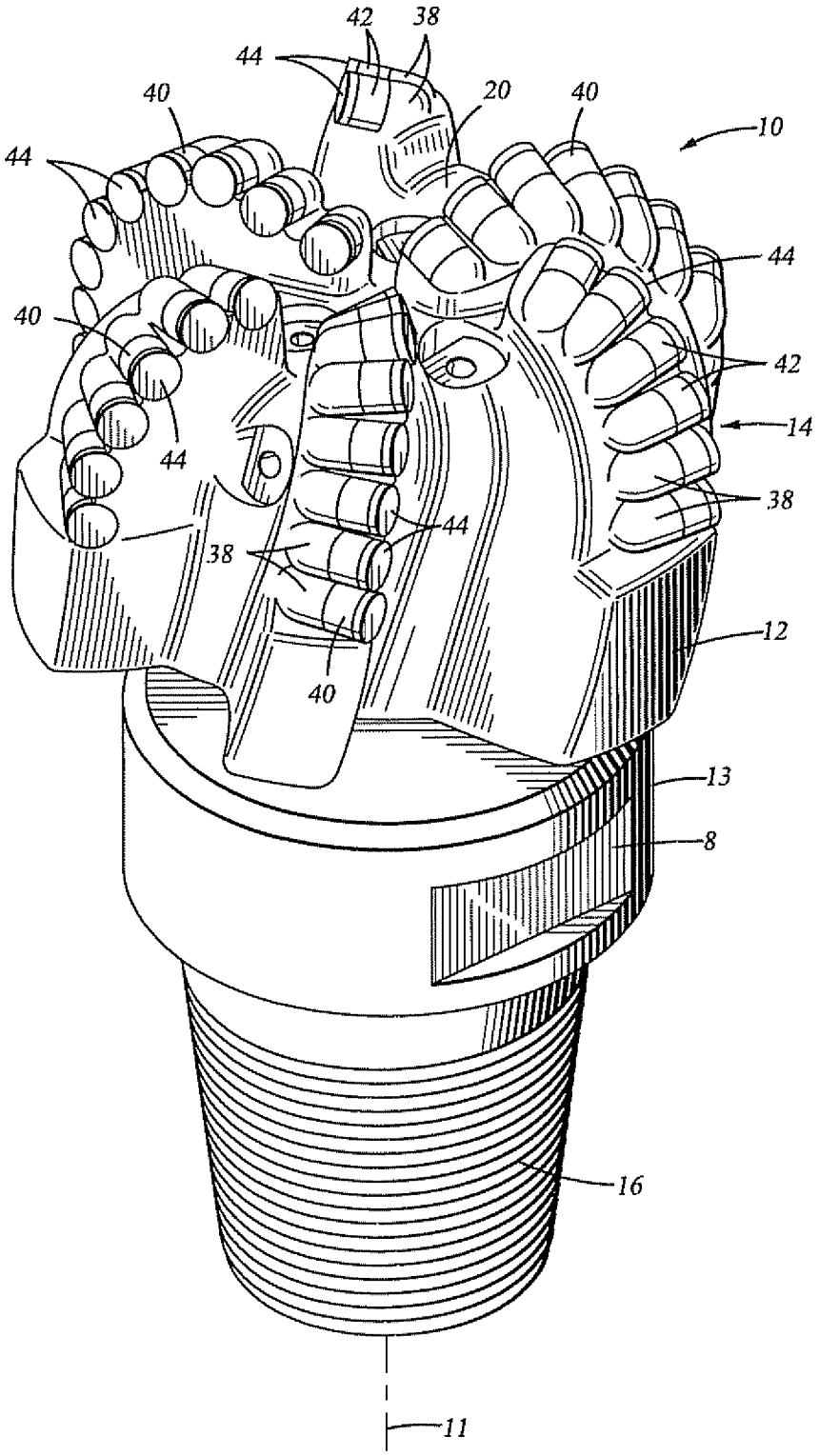
FIG. 1 is a perspective view of a drill bit.
Figure 2:
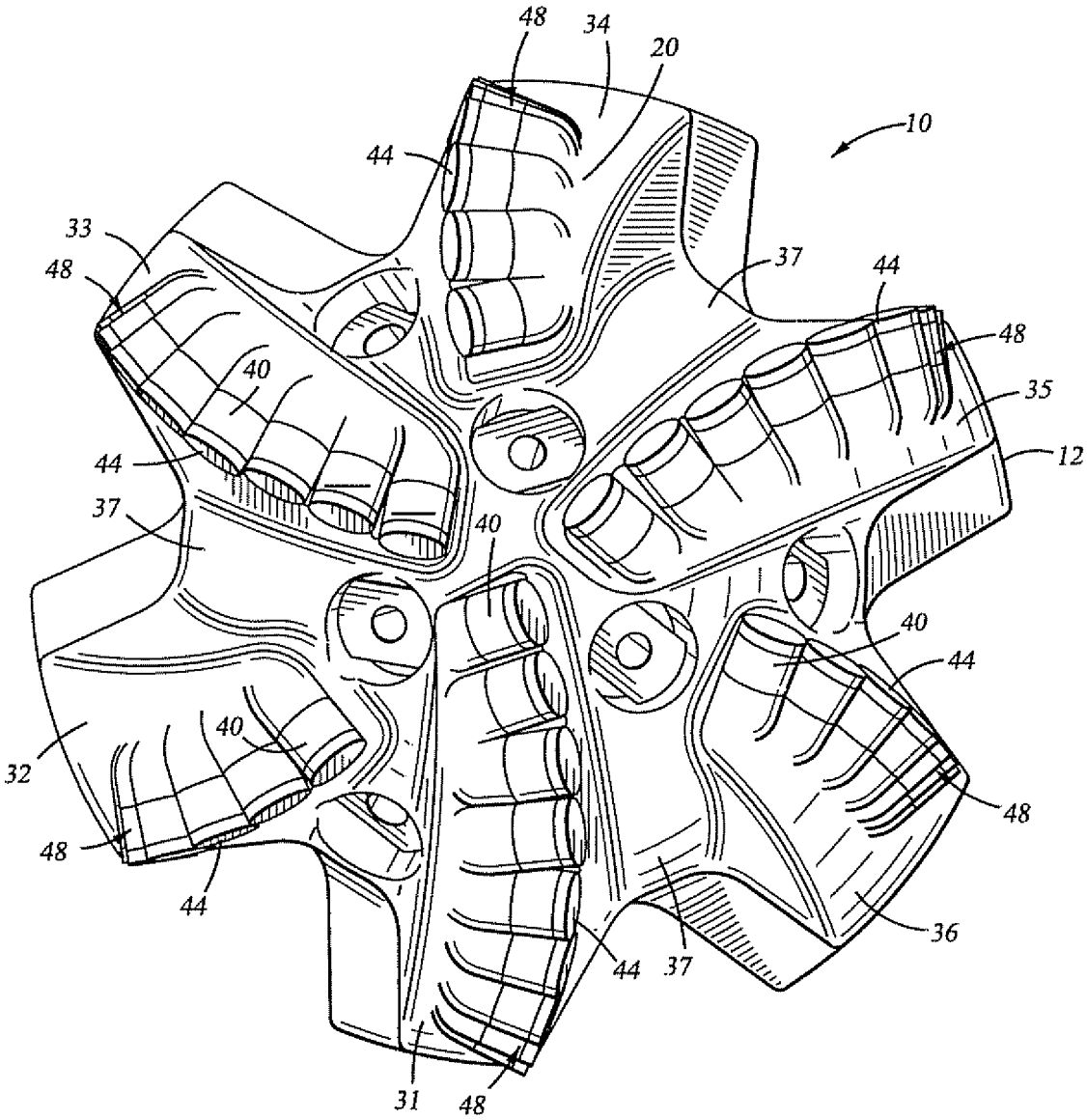
FIG. 2 is a view of the face of the drill bit of FIG. 1.
Figure 3:
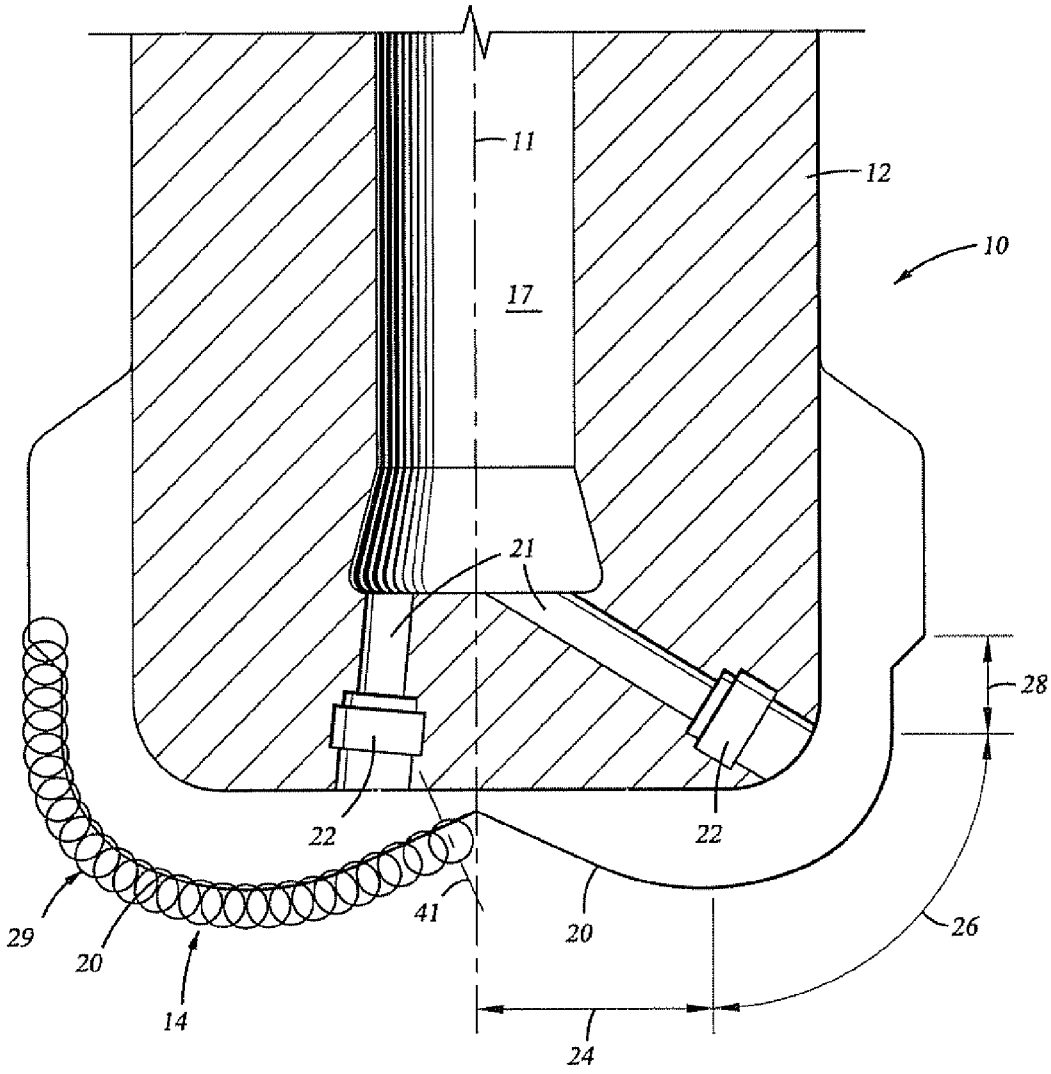
FIG. 3 is a schematic diagram of a drill bit according to the invention.

Referring to FIGS. 1-3, drill bit 10 is a fixed cutter bit, sometimes referred to as a drag bit, and is adapted for drilling through formations of rock to form a borehole. Bit 10 generally includes a central axis 11, a bit body 12, shank 13, and threaded connection or pin 16 for connecting bit 10 to a drill string (not shown) which is employed to rotate the bit for drilling the borehole. Bit 10 further includes a PDC cutting structure 14 having a plurality of cutter elements 40 described in more detail below.

Body 12 includes a central longitudinal bore 17 (FIG. 3) for permitting drilling fluid to flow from the drill string into the bit. Bit body 12 includes a bit face 20 which is formed on the end of the bit 10 that is opposite pin 16 and which supports cutting structure 14. Body 12 is formed in a conventional manner using powdered metal tungsten carbide particles in a binder material to form a hard metal cast matrix. Steel bodied bits, those machined from a steel block rather than a formed matrix, may also be employed in the invention. Bit face 20 includes six angularly spaced-apart blades 31-36 which are formed as part of and which extend from body 12. Blades 31-36 extend radially across the bit face 20 and longitudinally along a portion of the periphery of the bit. Blades 31-36 are separated by channels which define drilling fluid flow courses 37 between and along the cutter elements 40 which are mounted on the blades 31-36 of bit face 20.

As best shown in FIG. 3, bit body 12 is also provided with downwardly extending flow passages 21 having nozzles 22 disposed at their lowermost ends. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

As best shown in FIG. 1, each cutter element 40 is mounted within a pocket 38 which is formed in the bit face 20 on one of the radially and longitudinally extending blades 31-36. Cutter elements 40 are constructed by conventional methods and each typically includes a cylindrical base or support 42 having one end secured within a pocket 38 by brazing or similar means. Attached to the opposite end of the support 42 is a layer of extremely hard material, a synthetic polycrystalline diamond material which forms the cutting face 44 of element 40. Such cutter elements 40, generally known as polycrystalline diamond composite compacts, or PDC's, are commercially available from a number of manufacturers.

As shown in FIGS. 1 and 2, the cutter elements 40 are arranged in separate rows 48 along the profiles of blades 31-36 and are positioned along the bit face 20. The cutting faces 44 of the cutter elements 40 are oriented in the direction of rotation of the drill bit 10 so that the cutting face 44 of each cutter element 40 engages the earth formation as the bit 10 is rotated and forced downwardly through the formation.

To show the relative position of these cutting elements (also known as cutters), they are depicted in rotated profile, where they overlap. Certain cutter elements 40 are positioned on blades 31-36 at generally the same radial position as other elements 40 and therefore follow in the swath of kerf cut by a preceding cutter element 40. When such "following" elements also have substantially the same exposure height or degree of exposure to the earth formation being drilled, these elements may be referred to as "redundant" cutters. In the rotated profile of FIG. 3, the distinction between such redundant cutter elements cannot be seen.

According to embodiments of the invention, a sequence of formations to be drilled, and their characteristics (such as hardness or abrasiveness), can advantageously dictate the design of cutting elements on a drill bit. In order to optimize performance, a drill bit should be built so that it is tailored to a particular drilling sequence, with the designer knowledgeable of the formation depths and characteristics to be drilled. A goal of the invention is to design a drill bit that reduces the frequent tripping of the drill string known to be necessary when formation characteristics change significantly and causes catastrophic cutting element damage with resulting loss in bit life and ROP. The advantage of avoiding tripping the drill string will not be as great, however, if the ROP of the drill bit is drastically reduced in any given type of formation. In particular, it is advantageous to achieve conventional rates of penetration in a selected formation, normally the first encountered formation (unless the predominant amount of drilling would be through a second encountered formation, for example). Thus, one challenge when designing a drill bit according to the invention is to achieve an ROP in at least one type of formation (normally the first encountered) that is about equivalent to that achievable with known drill bits designed for that formation type.

These advantages are achieved by including multiple sets of cutting elements on the drill bit, the characteristics of each set being determined by conventional drill bit design techniques, but generally differing in some respect(s). The invention employs at least two different sets of cutting elements, each designed to cut through a different type of subterranean formation. A first set of cutting elements is designed to cut primarily through a first region of formation. A second set of cutting elements is designed to cut primarily through a second region of formation.

In some embodiments, the multiple sets of cutting elements differ in at least two of material, bevel size, and backrake angle. The difference in material affects the impact resistance and/or the abrasion resistance of the cutting elements. In some applications, the sets of cutting elements may differ by a change in bevel size for sets of cutters at the same radial position. Regardless, a first set of cutting elements is sacrificed to expose a second set of cutting elements upon drilling into a second type of formation characteristic, allowing continued drilling and avoiding tripping the drill string.

The invention may also be seen as a method of cutting a borehole through at least two regions of formation. The method includes cutting through a first region using primarily a first set of cutting elements and cutting through a second region using primarily a second set of cutting elements. In this context, the word "primarily" means that at least seventy percent of the formation is being cut by the set of cutters at issue. More preferably, an even greater percentage is being cut by these cutting elements, such as eighty or ninety percent, or more.

The method includes sacrificing the first set of cutting elements so that the second set of cutting elements can take over and be the primary cutters on the second formation. For example, the first set of cutting elements may break upon being subjected to the transition to the second formation. The term "sacrificing" a set of cutting elements means that that set of cutting elements is rendered an effectively non-cutting set. (i.e. active to non-active cutters).

Figure 4:
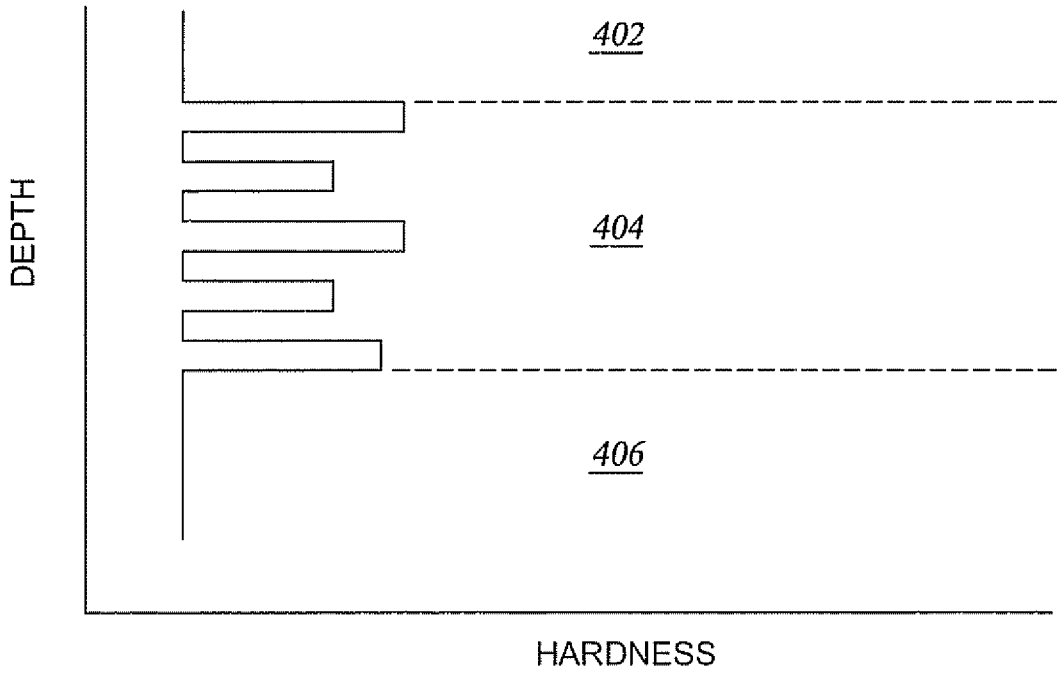
FIG. 4 is a graph showing the depth and hardness of a series of subterranean formations.

Referring to FIG. 4, a graph of a problematic series of formations is shown, with axes labeled depth and hardness. The driller may need to drill through a first region 402 of consistently soft formation such as a generally homogeneous sand, shale or carbonate, a second region 404 of highly variable hardness, such as alternating layers of hard and soft formation, or hard nodules impregnated in a soft formation. Region 406, below region 404, is again a consistently soft formation. The absolute hardness values of these regions is not as important as understanding the damage typically caused to a drag bit, also known as a PDC bit, when it encounters an abrupt transition from a soft to hard (or hard to soft) formation such as happens when moving from region 402 to region 404, or that occurs repeatedly in region 404. These severe changes in formation hardness break the cutting elements on the face of the drag bit, which drastically reduces bit life and ROP.

One of these two regions, or the transition from one region to another, creates high impact forces on the cutting elements of the PDC drill bit because of change in formation hardness. A drill bit designed to cut through this series of formations switches from the first set of cutting elements to the second set of cutting elements upon encountering these high impact forces. Additional sets of cutters to deal with additional regions of formations, and/or to better drill one of the previously-mentioned formation regions, may also be included on the drill bit.

First embodiments of the invention utilize cutting elements having chages in at least two of the following: impact resistance (toughness) of at least the cutting face of the cutting elements, the backrake angle of the cutting elements, and the bevel size of the cutting elements. This is one manner according to the invention to adapt drilling and performance characteristics of a drill bit to the types and sequences of formations to be drilled.

Bevel Size

Figure 5A:
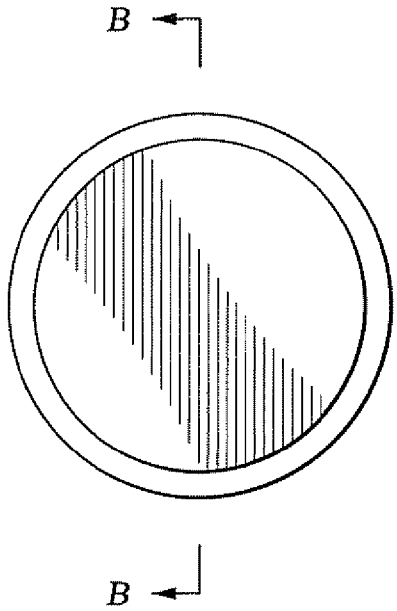
FIGS. 5A and 5B are views of a beveled insert.
Figure 5B:
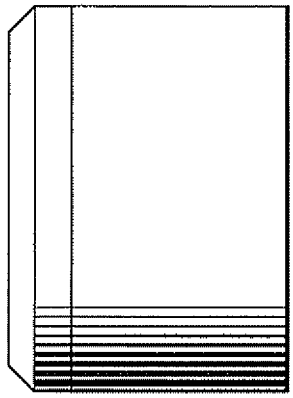

The concept of a beveled insert is known, although it has not previously been used in the manner disclosed herein. A beveled insert is characterized by its chamfered shape. Referring to FIGS. 5A and 5B, a small beveled cutter includes a PDC table supported by a carbide substrate. The interface between the PDC diamond table and the substrate may be planar or non-planar, according to many varying designs for same as known in the art. The cutting face of the cutter is to be oriented on a bit facing generally in the direction of bit rotation. The surface of the central portion of cutting face is planar as shown, although concave, convex, ridged or other substantially planar surfaces may be employed. A bevel or chamfer extends from the periphery of surface to cutting edge at the sidewall of the diamond table. The chamfer and cutting edge may extend about the entire periphery of table, or along only a periphery portion to be located adjacent the formation to be cut.

Figure 6A:
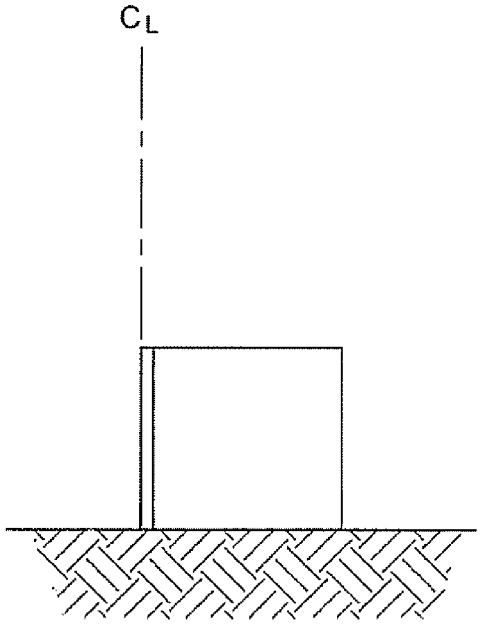
FIGS. 6A-6D are diagrams showing the definition of backrake.
Figure 6B:
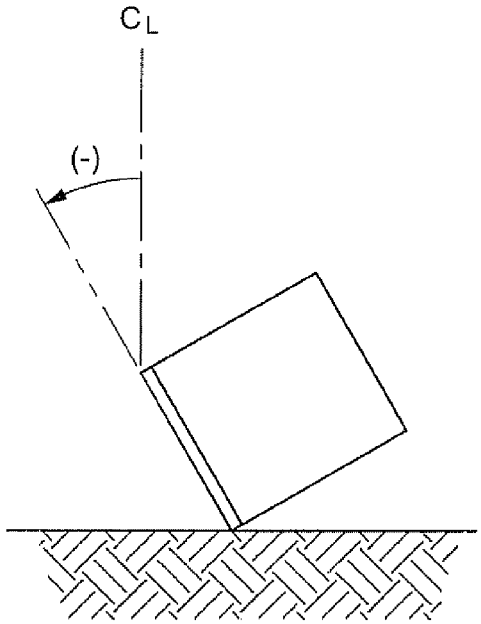
Figure 6C:
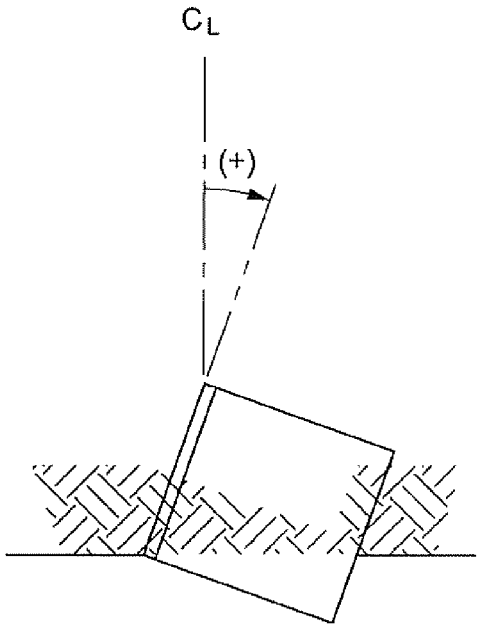
Figure 6D:
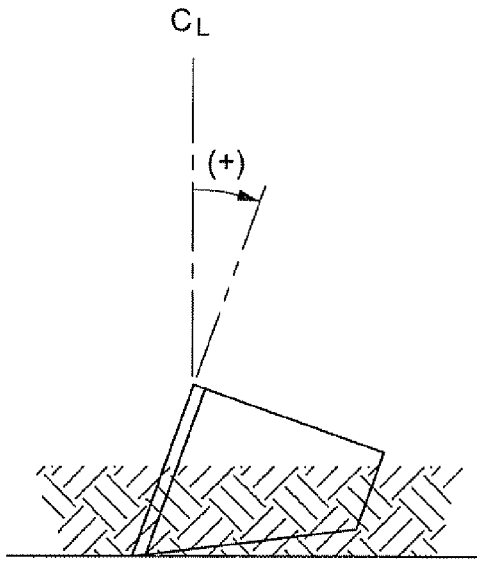

As is known to those of ordinary skill in the art, the size and angle of the bevel portion may vary. Generally, a larger bevel enhances cutter durability, by improving impact resistance. At the same time, larger bevel sizes reduce bit aggression and thus rate of penetration (ROP). A large bevel is generally used, therefore, to cut a hard formation, with a small bevel being better suited to cut through a softer formation Backrake The idea of placing the tip of a cutting element at a backrake angle to a formation is known, although it has not previously been used in the manner disclosed herein. In accordance with the invention, elements are mounted such that their cutting faces engage the formation material with varying degrees of "backrake." Referring to FIGS. 6A-6D, three cutters having cutting faces are shown mounted on a bit with different backrake angles. Backrake may generally be defined as the angle $\alpha$ formed between the cutting face of the cutter element and a line that is normal to the formation material being cut and that passes through the center of the cutting face. As shown in FIG. 6A, with a cutter element having zero backrake, the cutting face is substantially perpendicular or normal to the formation material. A cutter having a negative backrake angle $\alpha$ has a cutting face that engages the formation material at an angle that is less than 90 degrees as measured from the formation material, as depicted in FIG. 6B. Similarly, a cutter element having a positive backrake angle $\alpha$ has a cutting face which engages the formation material at an angle that is greater than 90 degrees when measured from the formation material as depicted in FIG. 6C. FIG. 6D shows an alternately shaped cutting element.

Where one cutting element has a negative backrake and another has a positive backrake, the cutting element with the negative backrake is less aggressive. Where both have positive backrake, the cutter with the lower backrake is less aggressive. Where both cutting elements have negative backrake angles, the cutting element with the more negative backrake angle is less aggressive. When two cutting elements have negative backrake, and the first is referred to as having greater backrake or more backrake than the second, it means that the first is more negative than the second.

Impact Resistant Material

The impact resistance of a cutting element material (such as PDC), also referred to as its toughness, is defined by the number of joules needed for breakage, and thus failure of the cutting element. The impact resistance of a material can be increased, albeit normally with a trade off in terms of a reduced ability for the material to withstand abrasion. Softer, less brittle materials tend to withstand impact better than harder, more brittle materials. It is known that the impact resistance of a PDC cutting element can be increased if it is manufactured with a diamond material having a larger grain size.

There are techniques that do not force a tradeoff between a material's impact resistance and abrasion resistance, however, and the invention also encompasses them. For example, leaching of the cutting material to a specific depth is one technique that can be used to improve toughness without compromising the material's resistance to abrasiveness, as generally disclosed in U.S. Pat. No. 6,481,511, which is hereby incorporated by reference for all purposes. Another approach is to use different PCD compositions such as PCD with different binder material compositions, PCD with different diamond densities, or PCD formed by different pressing process operations.

Figure 7:
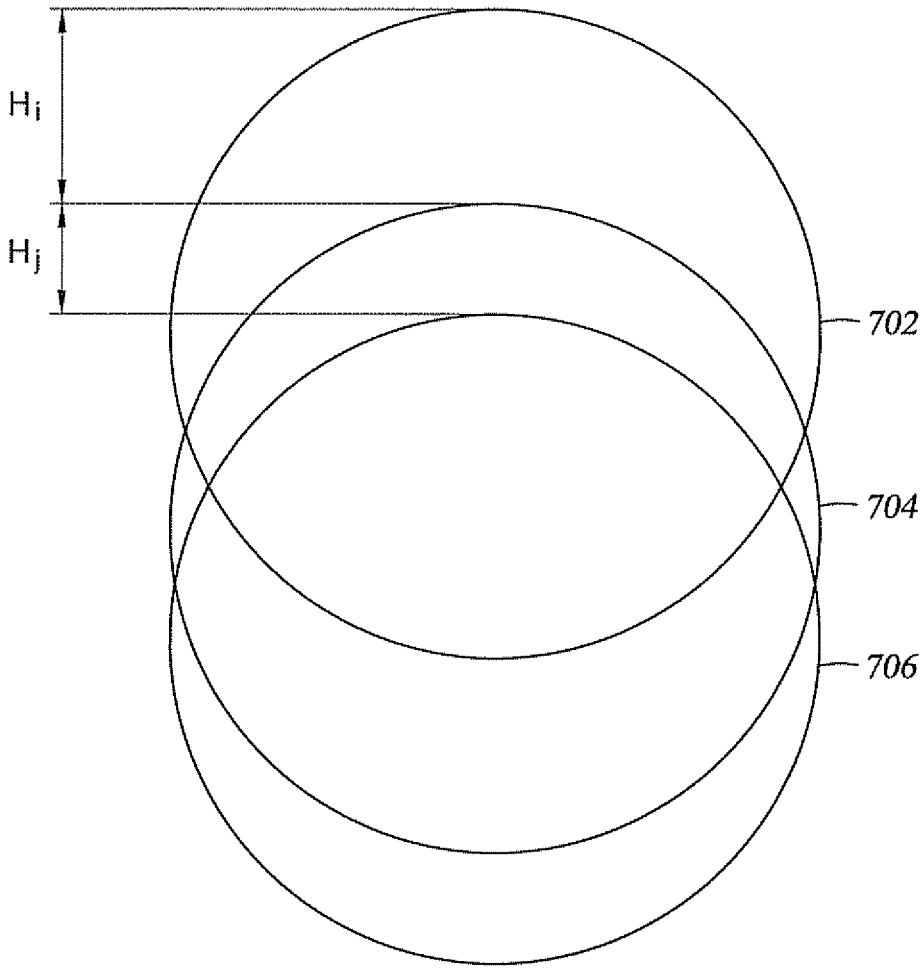
FIG. 7 is a schematic of three sets of cutting elements arranged to cut the formations of FIG. 4.

Referring to FIG. 7, embodiments of the invention that are suitable to drill the formations of FIG. 4 may include three sets of overlapping cutting elements at different heights. FIG. 7 shows the overlapping sets of cutter elements in rotated profile. In accordance with convention, the formation (not shown) to be cut is at the upper portion of FIG. 7, with the drill bit body (not shown) in the lower portion.

First set 702 of cutting elements has a first set of cutter characteristics. A first set of cutting elements 702 is thus at the greatest exposure, also equivalently referred to as height, and is therefore most exposed to the formation. Exposure or height is measured from the cutting tips of the cutting elements to the face of the drill bit body, at an angle in a direction parallel to the longitudinal axis of the drill bit. Exposure can also be measured from the tips of the cutters, to the bit body, in a direction perpendicular to a bit's profile (i.e. the face of the drill bit) at the specific location of cutter tip. If not specified, when a cutter is described herein as being more exposed or at a greater height than another cutter, either or both of these definitions may be satisfied. In this embodiment, first set 702 of cutting elements has twice as many cutting elements at the illustrated radial position and height than the sets of cutting elements 704 and 706. Review of FIGS. 1-2 shows an arrangement of cutting elements that permits one set of cutting elements to have twice as many cutters as another, for example. Being designed as a double set will assist the cutting performance in region 402, as depicted in this instance for a particular application.

Referring again to FIG. 7, the cutting tips of the cutting elements in second set 704 are recessed an amount $H_i$ from the cutting tips of the cutting elements in first set 702. The cutting elements of second set 704 are therefore less exposed to the formation than those in first set 702. Second set 704 would have a second set of cutter characteristics. In this case, second set 704 is adapted to cut, and withstand the high forces of, region 404.

The cutting tips of the cutting elements in third set 706 are recessed an amount Hj from the cutting tips of the cutting elements in the second set 704. The cutting elements of third set 706 are therefore less exposed to the formation than those in second set 704. Third set 706 of cutting elements would have a third set of cutter characteristics. As presented in this embodiment, the third set of cutting elements 706 is designed to cut through the soft formation of region 406.

It is not necessary to the invention for the sets of cutting elements to be at different heights or exposures to the formations. However, positioning of the cutting elements at different exposures may facilitate an easier transition from one set of cutting elements to another when drilling from one formation to another.

The defining characteristics for the sets of cutters are dependent upon the formation types for which the drill bit will be employed. In the example above, region 402 has been identified as a generally soft, consistent hardness region, region 404 has been identified as a region having great variation in hardness, and region 406 has been identified as a soft, consistent hardness region. In accordance with the first embodiments of the invention, the first set of cutting elements 702 will be configured to cut soft formation. This means that it will be configured aggressively. Aggressive cutters have e.g., low magnitude negative, or even positive, backrake angle, and have small bevel angles. Diamond material having high impact resistance can be used for such cutters.

Referring again to FIG. 4, another feature of some embodiments is a drill bit designed according to the invention is intended to cut through formation 402 at about the same ROP as known drill bits. In particular, the inclusion of a double set for the most exposed set of cutting elements increases its ability to cut through the first encountered formation.

In operation a drill bit built having cutting elements according to the embodiment of FIG. 7 uses the first cutter set to cut through the region 402 of low hardness variation, in this example a consistent (homogenous), relatively soft formation. The first set of cutters 702 approximates the performance of a drill bit specifically designed to cut only through soft formation 402. The first set of cutters is designed so that the second set of cutting elements does not become exposed while drilling formation 402. Upon reaching region 404, a depth at which the drill bit cuts into a significantly variable hardness formation, the first set of cutters responds in the typical manner, by breakage. The first set of cutters is thus sacrificed so that the second set of cutters 704 is exposed. Second set of cutting elements 704 is designed so that it will chip or wear away slowly, but not break away as is the case with conventional bits, while cutting through formation 404. If designed accurately the third set of cutting elements 706 is not exposed as the drill bit cuts through region 404. Third set of cutting elements 706 then becomes exposed due to the wear on second set of cutting elements 704 just as the drill bit has completed cutting through formation 404. Given that third set of cutting elements 706 is designed to cut region 406, the performance of drill bit built in accordance with this embodiment of the invention should be good in terms of rate of penetration (ROP) and bit life when drilling through formation 406.

To accomplish the goal for set of cutters 702 to drill through region 402 about as quickly as a conventional drill bit optimized to cut through soft formation, first set of cutters 702 is designed in a conventional manner to optimize design parameters such as bit profile, cutter size, back rake, side rake, and blade count for the set of cutting elements 702. Subsequently, the loading and work rates of this group of cutters is optimized to match that usually seen by conventional bits that will have been drilled and been pulled at the top of region 404. The result is that the ROP in this section or region is not significantly compromised. This adaptation process is achieved through the use of industry-available computer models which have, e.g., rock type and rock characteristics such as hardness/abrasiveness as inputs. In addition, operational parameters such as weight on bit (WOB) and bit revolutions per minute (RPM) may be used together with bit design parameters and features to predict an expected rate of penetration (ROP) and bit torque (TQ). In some instances, ROP and/or bit torque can be treated as inputs to the evaluation process with WOB being the output. This process may sometimes be done iteratively. The modeling and response of a particular drill bit design given particular formation parameters is known to those knowledgeable in the art of bit design and development.

The second set of cutters 704 will be configured to cut through the highly variable hardness, high impact region 404. This means that second set of cutting elements 704 must exhibit high impact resistance characteristics. This set of cutting elements thus has cutters with more impact resistance (e.g. large grain size diamond material), less aggressive backrake angles (normally a greater magnitude negative backrake angle), and larger bevels than those present in cutter set 702. The second set of cutting elements should be designed so that it wears away and exposes the third set of cutting elements 706 upon drilling through the second region 404. This may be controlled through selection of the appropriate diamond material for the second set of cutting elements. The specifics of the design for the second set of cutting elements may be optimized with respect to the target formation 404 in a conventional manner, given a combination of higher impact resistant cutter, less aggressive (e.g. higher magnitude negative) backrake angles, and larger bevel size. This process aims at matching the interval length (footage) and impact characteristics of zone 704 to the durability (impact resistance) of the second set of cutters.

The third set of elements 706 will be configured to cut the soft formation of region 406. The third set 706 should be modeled like the first set of cutter 702 (because the third set also is cutting soft formation), as per formation drillability and operational parameter requirements (WOB, RPM, ROP, TQ) to aggressively deploy the cutters in the soft region for effective bit performance. Consequently, the third set of cutting elements (as well as the first set of cutting elements) will have a lower impact resistance, will have a more aggressive backrake, meaning less negative or even positive backrake angles, and will have a smaller bevel size.

The impact resistance (toughness) of set of cutting elements 704 is higher than that of sets 702 and 706 because of the type of formation for which it is designed.

According to certain embodiments of the invention, the characteristics of the high-impact set of cutting elements (i.e. designed for regions of highly variable hardness) as compared to a low impact (i.e. low variability hardness regions) set of cutting elements are some combination of the following:

1) high impact resistance material. This may be accomplished by various approaches, such as a large grain size. The impact resistance of cutter set 704 would be higher than the impact resistance of the cutter sets 702, 706.

2) large bevel size. The bevel of the cutter elements designed to withstand high hardness variability regions (in this embodiment, the second set of cutters 704) should be larger than the bevel size for cutting elements designed to cut through a low hardness variability region.

3) less aggressive cutter backrake angle. The backrake angle for the cutting elements designed to cut through high hardness variability formation should be less aggressive than the backrake angle for cutting elements designed to cut through low hardness variability formation. Where both backrake angles are negative, this means that the backrake angle for the cutting elements designed to cut through high hardness variability formation should be more negative than those designed to cut through the low hardness variability formation. Consequently, where both sets of cutting elements have negative backrake angles, the negative backrake angle for the cutting elements designed to cut through high hardness variability formation should be more negative than the backrake angle for cutting elements designed to cut through low hardness variability formation.

Although it is believed that benefits accrue from the invention where the cutting elements of the high impact cutter simply have larger negative backrake, higher impact resistance, and larger bevel size than the cutters designed to cut the low impact variability regions, there should be a significant difference between the two sets in these characteristics to derive optimum performance. Because the drill bit will be optimized only with regard to specific formation sequences, it can not universally be said how large of a difference this might be. However, one example might be twice as large a bevel, 1.4 times as much impact resistances, and a 30 degree or 40 degree negative backrake instead of a 20 degree negative backrake.

Changes in formation hardness are not the only problem, however. Highly abrasive formations can wear cutting elements as extensively as drastic changes in formation hardness can break them. Second embodiments of the invention therefore utilize at least two changes in the following: a high abrasion resistant cutting element, backrake angle, and bevel size. These differences adapt the drilling and performance characteristics of the drill bit, based on the types and sequences of formations to be drilled.

Abrasion Resistant Material

The abrasion resistance of cutting element material is generally discussed in U.S. Pat. No. 5,607,024, which is hereby incorporated by reference for all purposes. Abrasion resistance can be achieved by smaller grain size in the material of the cutting surface. Impact resistance and abrasion resistance are may be manipulated by controlling the grain size of the material. In this case, impact resistance and abrasion resistance are inversely related. However, for other techniques this is not necessarily true.

Increased abrasion resistance can be achieved by other approaches, each of which is included in the scope of the invention. Although not limited to the following, high abrasion resistance for a cutting element can be achieved through, e.g., fine grain diamond material, different grades of diamond where the top layer is finer and thus has a higher abrasion resistance, and post-leaching of the metallic catalyst (cobalt and/or nickel) so that the top layer of the diamond table has no metal catalyst. In the case of post-leaching, the depth of the leached portion can be 0.010" or increased to 0.020" and even to 0.040". The depth of the leached portion also can be different from these values.

Other embodiments of the invention are adapted to cut through regions of differing abrasiveness. The characteristics of a set of cutting elements designed for regions of highly variable abrasiveness is some combination of the following:

1) high abrasive resistance material. This may be accomplished by various approaches, such as a small grain size.

2) large bevel size. The bevel of the cutter elements designed to withstand high abrasiveness variability regions should be larger than the bevel size for cutting elements designed to cut through a low abrasiveness variability region.

3) less aggressive cutter backrake angle. The backrake angle for the cutting elements designed to cut through high abrasiveness variability formation should be less aggressive than the backrake angle for cutting elements designed to cut through low abrasiveness variability formation.

Referring again to FIG. 7, cutter sets 702, 704, and 706 may be seen as being constructed to withstand regions of varying abrasiveness. In this event, the abrasive resistance of cutter set 704 would be higher than the impact resistance of the cutter sets 702, 706.

Other formations may be adequately drilled by simply the varying bevel size for sets of cutting elements located at substantially the same radial position. For a drill bit built in accordance with these embodiments, a first set of cutting elements having a first bevel size cuts a first region of formation. Upon encountering a second region of formation (or being otherwise worn or broken), the first set of cutting elements is broken or otherwise rendered a non-cutting set. A second set of cutting elements, having a bevel size different than the first set of cutting elements, takes over and cuts the second region of formation. The first set may be positioned higher than the second set in order to facilitate the transition from the first set to the second set. Consequently, the first set may have a larger bevel than the second set, or the first set may have a smaller bevel than the second set, depending upon the sequence of formations to be drilled.

The radial position of a cutting element is defined by the distance of the cutting tip from the longitudinal axis of the drill bit. Two cutting elements at the same radial position have the same distance between their respective cutting tips and the longitudinal axis of the drill bit. If two cutting elements are referred to as being at "substantially" the same radial position, it means that the cutting elements' radial positions are close enough that there is no effect on the cutting ability of the drill bit due to the difference in radial position.

Generally, a larger bevel enhances cutter durability, by improving impact resistance. At the same time, larger bevel sizes reduce bit aggression and thus rate of penetration (ROP). A large bevel is generally used, therefore, to cut a hard formation, with a small bevel being better suited to cut through a softer formation. One example of the relative bevel sizes for each of the cutting elements in one set of cutting elements be twice as large the bevel size for each of the cutting elements in another set of cutting elements. Alternately, some but not all of the cutting elements in the first set may have this relationship to the second set of cutting elements. Alternately, these relationships may be combined, with all (or the great majority like ninety percent or more) of the cutting elements in the first set being larger than all (or the great majority like ninety percent or more) of the cutting elements in the second set, with more than half of the cutting elements in the first set being twice as large as the cutting elements in the second set.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. For example, the size of the cutters may differ among different sets of cutting elements. Accordingly, the scope of protection is not limited to the embodiments described herein, but is only limited by the claims which follow, the scope of which shall include all equivalents of the subject matter of the claims.

What is claimed is:

1. A drill bit for drilling in an earthen formation, comprising:

a drill bit body having a face end, a connection end, and a longitudinal axis;

at least one of a first type of cutting element mounted to said face end of said drill bit body, said first type of cutting element having a first grain size, a first backrake, a first bevel size, and a cutting face for cutting a swath through the formation;

at least one of a second type of cutting element having a cutting face and being mounted to said face end of said drill bit body at substantially a same radial distance from said longitudinal axis as said first type of cutting element such that the cutting face of the second type of cutting element is disposed in the swath cut by the cutting face of the first type of cutting element when the drill bit is rotated about the longitudinal axis, said second type of cutting element having a second grain size, a second backrake, a second bevel size;

wherein said bevel size for said second type of cutting element is different than for said first type of cutting element; and at least one of the following is true:

said second type of cutting element is made from a material having a different impact resistance than is said first type of cutting element;

said backrake angle for said second type of cutting element is different than for said first type of cutting element.

2. The drill bit of claim 1, wherein said drill bit comprises a first set and a second set of cutting elements, said first set comprising a plurality of said first type of cutting elements, said second set comprising a plurality of said second type of cutting elements, wherein at least two of the following are true:

said impact resistance of the material for all of the cutting elements in said second set of cutting elements is greater than for the material in all of the cutting elements in said first set of cutting elements;

said bevel size for all of the cutting elements in said second set of cutting elements is larger than for all of the cutting elements in said first set of cutting elements; and said backrake angle for all of the cutting elements in said second set of cutting elements is less aggressive than for all of the cutting elements in said first set of cutting elements.

3. The drill bit of claim 2, said grain size being larger for said second set of cutting elements than for said first set of cutting elements, said backrake angle being less aggressive for said second set of cutting elements than for said first set of cutting elements.

4. The drill bit of claim 2, said bevel size being larger for said second set of cutting elements than for said first set of cutting elements, said backrake angle being less aggressive for said second set of cutting elements than for said first set of cutting elements.

5. The drill bit of claim 2, said grain size and bevel size being greater for said second set of cutting elements than for said first set of cutting elements.

6. The drill bit of claim 2, said first and second sets of cutting elements having the same exposure.

7. The drill bit of claim 2, said first set of cutting elements being more exposed with respect to said drill bit body than said second set.

8. The drill bit of claim 2, said second set of cutting elements being more exposed with respect to said drill bit body than said first set.

9. The drill bit of claim 2, said grain size in said material comprising a set of cutting surfaces for said second set of cutting elements being at least 1.4 times the grain size in a set of cutting surfaces for said first set of cutting elements.

10. The drill bit of claim 2, wherein all of said cutting elements in said first set of cutting elements have a positive backrake angle.

11. The drill bit of claim 2, wherein all of said cutting elements in said first set of cutting elements are larger than all of said cutting elements in said second set of cutting elements.

12. The drill bit of claim 2, wherein said impact resistance of the material for all of the cutting elements in said second set of cutting elements is greater than for the material of all the cutting elements in said first set of cutting elements;

wherein said bevel size for all of the cutting elements in said second set of cutting elements is larger than for all of the cutting elements in said first set of cutting elements; and wherein said backrake angle for all the cutting elements in said second set of cutting elements is less aggressive than for all the cutting elements in said first set of cutting elements.

13. The drill bit of claim 12, wherein said first set of cutting elements have a higher exposure with respect to said drill bit body than said second set.

14. The drill bit of claim 12, wherein said second set of cutting elements have a higher exposure with respect to said drill bit body than said first set.

15. The drill bit of claim 12, wherein said first and second sets of cutting elements being equally exposed with respect to said drill bit body.

16. The drill bit of claim 12, wherein said grain size proximal said cutting surfaces of said second set of cutting elements is at least about 1.4 times the grain size proximal said first set of cutting elements.

17. The drill bit of claim 12, wherein said bevel size of said second set of cutting elements being at least about twice that of said bevel size for said first set of cutting elements.

18. The drill bit of claim 12, said first set of cutting elements and said second set of cutting elements both having a negative backrake, said negative backrake of said second set of cutting elements being at least one and one half times that of said first set of cutting elements.

19. The drill bit of claim 2, wherein said second set has a negative backrake angle of greater than or equal to negative thirty degrees.

20. The drill bit of claim 19, where said first set has a negative backrake of greater than or equal to negative twenty degrees.

21. The drill bit of claim 20, said third set of cutting elements being mounted at a different exposure with respect to said drill bit body than both said first and second sets of cutting elements.

22. The drill bit of claim 1, further comprising:

at least one of a third type of cutting element mounted to said face end of said drill bit body, said third type of cutting element having a third grain size, a third backrake angle and a third bevel size, wherein at least two of the following are true:

said second type of cutting element being made from a material with an impact resistance that is different than for said third type of cutting element;

said bevel size for said second type of cutting element is different than for said third type of cutting element; and said backrake angle for said second type of cutting element is different than for said third type of cutting element.

23. The drill bit of claim 22, wherein said drill bit comprises a third set of cutting elements, said third set comprising a plurality of said third type of cutting elements, wherein at least two of the following are true:

said impact resistance for the material making all of the cutting elements in said second set of cutting elements is greater than the material for all of the cutting elements in said third set of cutting elements;

said bevel size for all of the cutting elements in said second set of cutting elements is larger than for all of the cutting elements in said third set of cutting elements; and said backrake angle for all of the cutting elements in said second set of cutting elements is less aggressive than for all of the cutting elements in said third set of cutting elements.

24. The drill bit of claim 23, wherein said impact resistance for said second set of cutting elements is greater than for said first set of cutting elements, said bevel size for said second set of cutting elements is larger than for said first set of cutting elements, and said backrake angle for said second set of cutting elements is less aggressive than for said first set of cutting elements.

25. The drill bit of claim 23, said first set being at a greater exposure than said second set, with said second set being a greater exposure than said third set.

26. The drill bit of claim 1, said cutting elements of said first set of cutting elements comprising cutting surfaces, said cutting surfaces being comprised of a more abrasion resistant material than material comprising cutting surfaces for the cutting elements of said second set of cutting elements.

27. The drill bit of claim 26, said more abrasion resistant material comprising a more fine grain than the material comprising the cutting surfaces for the cutting elements of said second set of cutting elements.

28. The drill bit of claim 26, said more abrasion resistant material being leached so that said more abrasion resistant material contains less metal than the material comprising the cutting surfaces for the cutting elements of said second set of cutting elements.

29. The drill bit of claim 1, said first and second sets of cutting elements having the same exposure.

30. The drill bit of claim 1, wherein said second type of cutting element has a negative backrake angle.

31. The drill bit of claim 30, wherein said first type of cutting element has a negative backrake angle and said second type of cutting element has a backrake angle more negative than said first type of cutting element.

32. The drill bit of claim 30, wherein all of said cutting elements in said second set of cutting elements have a negative backrake angle.

33. The drill bit of claim 30, wherein all of said cutting elements in said first set of cutting elements have a negative backrake angle and all of said cutting elements in said second set of cutting elements have backrake angles more negative than that of said first set of cutting elements.

34. The drill bit of claim 1, wherein said first cutting element has a positive backrake angle.

35. A drill bit for drilling in an earthen formation, comprising:

a drill bit body having a face end, a connection end, and a longitudinal axis;

at least one of a first type of cutting element mounted to said face end of said drill bit body, said first type of cutting element having a first backrake, a first bevel size, a cutting face for cutting a swath through the formation. and being made from a first material;

at least one of a second type of cutting element having a cutting face and being mounted to said face end of said drill bit body at substantially a same radial distance from said longitudinal axis as said first type of cutting element such that the cutting face of the second type of cutting element is disposed in the swath cut by the cutting face of the first type of cutting element when the drill bit is rotated about the longitudinal axis, said second type of cutting element having a backrake, a second bevel size, and being made from a second material;

wherein said bevel size for said second type of cutting element is different than for said first type of cutting element; and at least one of the following is true:

said second type of cutting element being made from a material having a different abrasion resistance than is said first type of cutting element;

said backrake angle for said second type of cutting element is different than for said first type of cutting element.

36. The drill bit of claim 35, wherein said drill bit comprises a first set and a second set of cutting elements, said first set comprising a plurality of said first type of cutting elements, said second set comprising a plurality of said second type of cutting elements, wherein at least two of the following are true:

said abrasion resistance of the material for all of the cutting elements in said second set of cutting elements is greater than for the material in all of the cutting elements in said first set of cutting elements;

said bevel size for all of the cutting elements in said second set of cutting elements is larger than for all of the cutting elements in said first set of cutting elements; and said backrake angle for all of the cutting elements in said second set of cutting elements is less aggressive than for all of the cutting elements in said first set of cutting elements.

37. The drill bit of claim 36, wherein said abrasion resistance is greater and said bevel size are larger for all the cutting elements in said second set of cutting elements than for all the cutting elements in said first set of cutting elements, and said backrake angle for all the cutting elements in said second set of cutting elements is less aggressive than for all the cutting elements in said first set of cutting elements.

38. The drill bit of claim 37, wherein said first set of cutting elements have a higher exposure with respect to said drill bit body than said second set.

39. The drill bit of claim 37, wherein said second set of cutting elements have a higher exposure with respect to said drill bit body than said first set.

40. The drill bit of claim 37, wherein said first and second sets of cutting elements being equally exposed with respect to said drill bit body.

41. The drill bit of claim 35, said cutting elements of said first set of cutting elements comprising cutting surfaces, said cutting surfaces being comprised of a more impact resistant material than material comprising cutting surfaces for the cutting elements of said second set of cutting elements.

42. The drill bit of claim 41, said more impact resistant material comprising a greater size grain than the material comprising the cutting surfaces for the cutting elements of said second set of cutting elements.

43. The drill bit of claim 41, said more impact resistant material being leached so that said more impact resistant material contains less metal than the material comprising the cutting surfaces for the cutting elements of said second set of cutting elements.

44. A drill bit for drilling in an earthen formation, comprising:

a drill bit body having a face end, a connection end, and a longitudinal axis;

at least one of a first type of cutting element mounted to said face end of said drill bit body, said first type of cutting element having a first bevel size, and a cutting face for cutting a swath through the formation; and at least one of a second type of cutting element having a cutting face and being mounted to said face end of said drill bit body at substantially a same radial distance from said longitudinal axis as said first type of cutting element such that the cutting face of the second type of cutting element is disposed in the swath cut by the cutting face of the first type of cutting element when the drill bit is rotated about the longitudinal axis, said second type of cutting element having a second bevel size;

wherein said bevel size of said second type of cutting element is different than said bevel size of said first type of cutting element.

45. A drill bit according to claim 44, wherein said first type of cutting element has a first backrake angle and said second type of cutting element has a second backrake angle; and wherein said backrake angle of said second type of cutting element is different than said backrake angle of said first type of cutting element.

46. A drill bit according to claim 45, wherein said first type of cutting element has a first exposure with respect to said drill bit body, and said second type of cutting element has a second exposure with respect to said drill bit body; and wherein said second exposure is different than said first exposure.

47. A drill bit according to claim 45, wherein said drill bit comprises a first set and a second set of cutting elements, said first set comprising a plurality of said first type of cutting elements, said second set comprising a plurality of said second type of cutting elements, wherein:

said bevel size for all of said second type of cutting elements in said second set is larger than for all of said first type of cutting elements in said first set; and, said backrake angle for all of said second type of cutting elements in said second set is less aggressive than for all of said first type of cutting elements in said first set.

48. A drill bit according to claim 47, wherein said first set of cutting elements have a higher exposure with respect to said drill bit body than said second set of cutting elements.

49. A drill bit according to claim 47, wherein said second set of cutting elements have a higher exposure with respect to said drill bit body than said first set of cutting elements.

50. A drill bit according to claim 47, wherein said first and second sets of cutting elements are equally exposed with respect to said drill bit body.

51. A drill bit according to claim 47, wherein said bevel size of each of said second type of cutting element in said second set is at least about twice said bevel size of each of said first type of cutting element in said first set.

52. A drill bit according to claim 45, comprising:

at least one of a third type of cutting element mounted to said face end of said drill bit body, said third type of cutting element having a third backrake angle and a third bevel size, wherein:

said bevel size of said second type of cutting element is different than said bevel size of said third type of cutting element; and said backrake angle of said second type of cutting element is different than said backrake angle of said third type of cutting element.

53. A drill bit according to claim 52, wherein said drill bit comprises a first set of cutting elements, a second set of cutting elements, and a third set of cutting elements, said first set comprising a plurality of said first type of cutting elements, said second set comprising a plurality of said second type of cutting elements, and said third set comprising a plurality of said third type of cutting elements, wherein:

said bevel size of each of said second type of cutting elements in said second set is larger than said bevel size for each of said third type of cutting element in said third set; and, said backrake angle of each of said second type of cutting elements in said second set is less aggressive than said backrake angle of each of said third type of cutting element in said third set.

54. A drill bit according to claim 53, wherein each of said third type of cutting element in said third set being mounted at a different exposure with respect to said drill bit body than said first type of cutting elements in said first set and said second type of cutting elements in said second set.

55. A drill bit according to claim 54, wherein each of said first type of cutting element in said first set being at a greater exposure with respect to said drill bit body than each of said second type of cutting element in said second set, and each of said second type of cutting element in said second set being at a greater exposure with respect to said drill bit body than each of said third type of cutting element in said third set.

56. A method according to claim 45, wherein said first type of cutting element has a first backrake angle and said second type of cutting element has a second backrake angle that is different from said first backrake angle.

57. A method according to claim 45, wherein said first type of cutting element has a first exposure with respect to said drill bit body and said second type of cutting element has a second exposure with respect to said drill bit body that is different than said first exposure.

58. A method according to claim 45, comprising: sacrificing said first set of cutting elements; sacrificing said second set of cutting elements; and, cutting through a third formation using primarily a third set of cutting elements.

59. A method for cutting a borehole through a first formation and a second formation of different hardnesses, the method comprising:

providing a drill bit comprising:

a drill bit body having a face end, a connection end, a central axis;

at least one of a first type of cutting element mounted to said face end and having a cutting face for cutting a swath through the first formation and the second formation;

at least one of a second type of cutting element having a cutting face and being mounted to said face end;

wherein said first type of cutting element has a first impact resistance and a first bevel size, and said second type of cutting element has a second impact resistance different from said first impact resistance and a second bevel size different from said first bevel size; and wherein said first type of cutting element and said second type of cutting element being mounted at the same radial position such that the cutting face of the second type of cutting element is disposed in the swath cut by the cutting face of the first type of cutting element when the drill bit is rotated about the central axis;

cutting through said first formation using primarily said first set of cutting elements; sacrificing said first set of cutting elements; and, cutting through said second formation using said second set of cutting elements.

* * * * *